US011549260B2

(12) United States Patent
Fatcheric

(10) Patent No.: US 11,549,260 B2
(45) Date of Patent: Jan. 10, 2023

(54) WALL PANEL FASTENING SYSTEMS AND METHODS

(71) Applicant: Jeffrey Fatcheric, Weedsport, NY (US)

(72) Inventor: Jeffrey Fatcheric, Weedsport, NY (US)

( * ) Notice: Subject to any disclaimer, the term of this patent is extended or adjusted under 35 U.S.C. 154(b) by 214 days.

(21) Appl. No.: 16/904,328

(22) Filed: Jun. 17, 2020

(65) Prior Publication Data

US 2020/0392727 A1 Dec. 17, 2020

Related U.S. Application Data

(60) Provisional application No. 62/862,269, filed on Jun. 17, 2019.

(51) Int. Cl.
*E04B 2/74* (2006.01)
*E04F 13/08* (2006.01)

(52) U.S. Cl.
CPC ..... *E04B 2/7453* (2013.01); *E04F 13/0825* (2013.01); *E04F 2201/01* (2013.01)

(58) Field of Classification Search
CPC .. E04B 2/453; E04B 13/0825; E04B 13/0882; E04B 2201/01
See application file for complete search history.

(56) References Cited

U.S. PATENT DOCUMENTS 3,475,810 A * 11/1969 Mates ..... A44B 18/00 52/DIG. 2
3,807,112 A * 4/1974 Perina ..... E04B 2/74 52/285.3
3,863,412 A * 2/1975 Bodycomb ..... E04B 2/7457 52/346
3,991,534 A * 11/1976 Brumlik ..... E04B 1/49 24/442
4,011,704 A * 3/1977 O'Konski ..... E04C 3/07 52/481.1
4,068,428 A * 1/1978 Peterson, III ..... E06B 3/28 160/354
4,090,335 A * 5/1978 Curatolo ..... E04B 2/7422 24/442

(Continued)

FOREIGN PATENT DOCUMENTS

JP H05141071 A * 6/1993

OTHER PUBLICATIONS

Velcro Brand 2015 US Product Line Brochure.

*Primary Examiner* — James M Ference
(74) *Attorney, Agent, or Firm* — Heslin Rothenberg Farley & Mesiti P.C.; Kristian E. Ziegler, Esq.

(57) ABSTRACT

The disclosure provides systems and methods for fastening wall and ceiling panels, such as drywall sheets, to framing members. The back side of the panels comprise a first touch fastening component of a touch or hook and loop fastening system configured to removably couple with a second touch fastening component of the fastening system. The second touch fastening component is provided on an outer surface of framing members that are configured to physically support the panels. The second touch fastening component may be coupled to a framing member, or may formed integral by the framing member. Some framing members may comprise a stud/joist, a c-channel, a fixed furring strip or an adjustable furring. The disclosed systems and methods may form walls, ceiling, partitions and the like.

12 Claims, 11 Drawing Sheets

(56) References Cited

U.S. PATENT DOCUMENTS 4,513,551 A * 4/1985 Gauffin ..... E04B 2/789 52/364
4,562,675 A * 1/1986 Baigas, Jr. ..... E06B 3/285 160/354
4,581,865 A * 4/1986 Miller ..... E06B 3/28 52/202
4,720,957 A * 1/1988 Madray ..... E04B 1/24 52/846
4,744,189 A * 5/1988 Wilson ..... B44C 7/022 434/421
4,796,397 A * 1/1989 Capaul ..... E04F 13/088 428/116
4,866,899 A * 9/1989 Houser ..... E04B 2/7863 52/842
4,974,384 A * 12/1990 Pacione ..... E04F 13/0882 52/483.1
5,060,443 A * 10/1991 Pacione ..... E04F 15/02138 52/483.1
5,133,166 A * 7/1992 Pacione ..... E04G 11/50 52/250
5,144,786 A * 9/1992 Pacione ..... E04F 15/02138 52/745.1
5,259,163 A * 11/1993 Pacione ..... E04F 13/0882 52/511
5,605,024 A * 2/1997 Sucato ..... E04C 3/36 52/696
5,632,127 A * 5/1997 Agar ..... E04B 2/7453 52/489.2
5,906,080 A * 5/1999 diGirolamo ..... E04B 2/96 52/656.1
5,950,386 A * 9/1999 Shipman ..... E04F 11/00 52/239
5,974,753 A * 11/1999 Hsu ..... E04F 13/0862 52/287.1
6,205,740 B1 * 3/2001 Ekerholm ..... E04C 3/09 52/670
6,751,915 B2 * 6/2004 Crowley ..... E04F 13/10 52/211
7,064,280 B1 * 6/2006 Rodgers ..... H05K 9/0003 174/394
7,866,112 B2 * 1/2011 Edmondson ..... E04C 3/07 52/646
8,074,416 B2 * 12/2011 Andrews ..... E04B 2/767 403/230
8,225,581 B2 * 7/2012 Strickland ..... E04B 2/789 52/855
8,919,064 B2 * 12/2014 Valle ..... E04C 2/06 52/855
8,984,838 B2 * 3/2015 Bordener ..... E04B 1/68 52/573.1
9,140,017 B1 * 9/2015 Oliver ..... E04F 13/075
9,359,771 B1 * 6/2016 Delforte ..... E04F 13/0882
9,518,393 B2 * 12/2016 Bordener ..... E04F 13/083
9,624,661 B2 * 4/2017 Poulakis ..... A44B 18/008
9,650,790 B2 * 5/2017 Bordener ..... E04F 13/0803
10,024,056 B2 * 7/2018 Pacione ..... E04F 15/02016
10,208,487 B1 * 2/2019 Kimmerle ..... E04F 13/0882
10,550,580 B1 * 2/2020 Longo ..... E04F 13/0882
11,098,494 B2 * 8/2021 Lesage ..... E04H 1/1272
2003/0070391 A1 * 4/2003 Tachauer ..... E04D 5/147 52/506.05
2005/0055967 A1 * 3/2005 Kariakin ..... E04C 3/07 52/855
2005/0076600 A1 * 4/2005 Moody ..... E04B 2/58 52/633
2006/0144009 A1 * 7/2006 Attalla ..... E04C 3/11 52/831
2009/0013633 A1 * 1/2009 Aubuchon ..... B21D 13/02 52/634
2009/0205282 A1 * 8/2009 Belsley ..... E04B 2/7453 52/565
2009/0282759 A1 * 11/2009 Porter ..... E04B 2/7457 52/220.1
2010/0050548 A1 * 3/2010 Krieger ..... E04B 2/7453 52/285.3
2012/0011795 A1 * 1/2012 Pacione ..... A47G 27/0475 156/289
2013/0111840 A1 * 5/2013 Bordener ..... E04B 1/40 52/393
2015/0191912 A1 * 7/2015 Bordener ..... E04F 13/10 52/772
2015/0204063 A1 * 7/2015 Poulakis ..... E04F 13/047 24/445
2015/0240486 A1 * 8/2015 Sacks ..... E04B 2/7412 52/633
2018/0298617 A1 * 10/2018 Drochon ..... E04F 15/02138
2019/0112819 A1 * 4/2019 Gebhardt ..... E04F 13/0882
2020/0392727 A1 * 12/2020 Fatcheric ..... E04F 13/0825

* cited by examiner

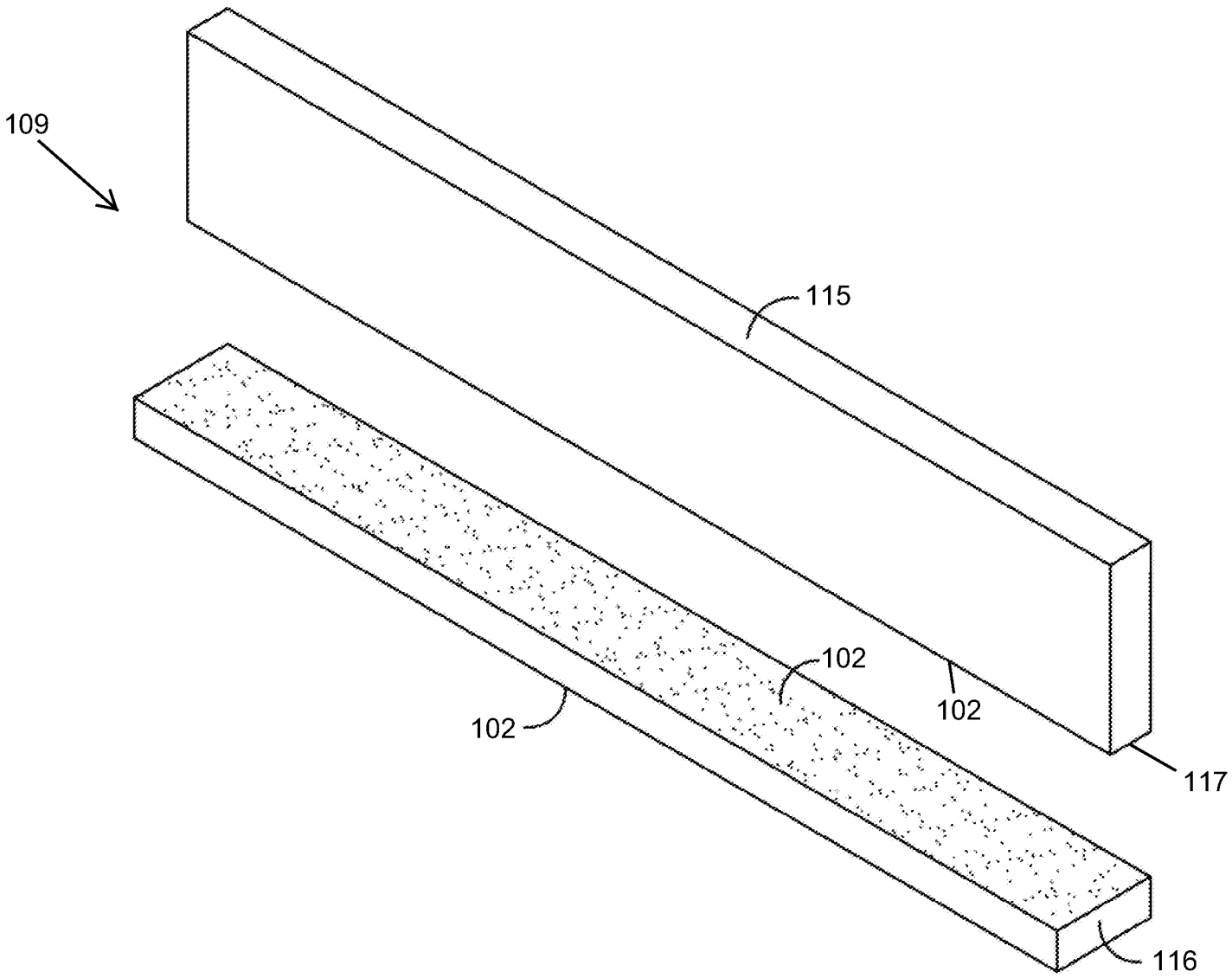
FG. 8A

WALL PANEL FASTENING SYSTEMS AND METHODS

CROSS-REFERENCE TO RELATED APPLICATION

This patent application perfect and claims priority benefit to U.S. Provisional Patent Application No. 62/862,269, filed Jun. 17, 2019, and entitled Drywall System and Method. The entire contents of the aforementioned application is hereby incorporated herein by reference.

TECHNICAL FIELD

The present disclosure generally relates to the field of commercial and residential space wall construction. More particularly, the present disclosure relates to wall panel (e.g., drywall) installation systems for commercial and residential interior spaces.

BACKGROUND

Drywall (also known as plasterboard, wallboard, sheet rock, gypsum board, buster board, custard board, or gypsum panel) and other panelized wall/ceiling coverings (e.g., thin sheet form) are a common building materials used as facing for interior walls or ceilings in most modern housing and commercial construction. Drywall and like panels are typically connected to wall or ceiling studs by using nails and/or screws and/or adhesives. A common occurrence with drywall and like panels is referred to as "screw pops" or "nail pops." This is a dimpling on the surface of the panel caused because a screw or nail has been worked free or because the nail or screw has been put in too deeply and through the panel, causing the panel to bow outward. This is also an indication that the panel is not being supported by the screws or nails. To mitigate dimpling, adhesives or tapes are used to connect the panel to the studs prior to putting in screws or nails. However, while using adhesives or tapes mitigates the problem, dimpling is not eliminated because often uneven surfaces result in the adhesive or tape not bonding properly.

Another issue with using screws or nails and adhesives or tapes to attach wall/ceiling covering panels to support structure (e.g., headers, footers, studs, etc.) is extreme temperatures, such as in the north-eastern part of the United States. Drywall and like panels may be installed on building surfaces that have temperatures that with ranges from below 10° F. to above 110° F. Use of adhesives and nails or screws limit the ability of materials to expand or contract with temperature changes, causing panel warping or connectivity loss, and also "screw pops."

Additives or material layers may be put into drywall and like panels to add water resistance or fire resistance. Sound dampening is usually achieved by using multiple layers of panels. It is also difficult to achieve water resistance, sound dampening, and fire resistance without using multiple layers of panels.

When it comes to replacement of installed drywall and like panels, the panels/sheets are generally ripped away, with the panels being broken during removal. It is common that a significant amount of residue is left on the support framing/members (along with the nails or screws). This residue typically must to be removed before new drywall/panels are installed. Also common is that the adhesive and screw or nail combination may damage the support framing when the drywall/panels are removed, requiring that the support framing be replaced.

Thus, a need exists to prevent dimpling of drywall or like wall/ceiling panels, and to have quicker, stronger, easier and/or less damaging wall/ceiling drywall/panel removal. A need also exists to include safety and ergonomic features to walls and ceilings constructed with drywall or like wall/ceiling panels, and the processes of constructing them.

SUMMARY

The present disclosure provides, in one aspect, a drywall installation system having a drywall sheet with a front side and a back side, a wall member, and a touch fastener. The touch fastener includes a first fastening component and a second fastening component configured for attachment to two opposing surfaces to be removably fastened, the first fastening component attached to the back side of the drywall sheet and the second fastening component attached to the wall member. The wall member is disposed in a wall space and connected to a building framework component, and the drywall sheet is disposed in relation to the wall member such that the first fastening component is operably engaged with the second fastening component.

A further aspect of the present disclosure provides a method for installing drywall including, providing a touch fastener having a first fastening component and a second fastening component configured for attachment to two opposing surfaces to removably be fastened. Providing a drywall sheet having a front side and a back side, with the first fastening component attached to the back side. Further providing a wall member, where the second fastening component is attached to the wall member. The next steps includes connecting the wall member to a building frame component within a wall space, aligning the drywall sheet, and placing the backside of the drywall such that the first fastening component and the second fastening component are fastened.

A further aspect of the disclosure provides a drywall installation system for removable connection to a building member having, a drywall sheet having a front side and a back side. The back side has a first fastening component of a touch fastener configured for removable attachment to a second fastening component of the touch fastener, and the first fastening component includes sound dampening material.

In another aspect, the present disclosure provides a wall panel fastening system. The system comprises: a wall panel sheet having a front side and a back side; a framing member configured to physically support the wall panel sheet; and a touch fastener comprising a first touch fastening component and a second touch fastening component configured to removably couple together when operatively engaged, the back side of the wall panel sheet including the first touch fastening component and an outer surface of the framing member including the second touch fastening component. The framing member is disposed in a wall space and coupled to building framework. The wall panel sheet is disposed in relation to the framing member such that the first touch fastening component is operably engaged with the second touch fastening component to removably fasten the wall panel sheet and the framing member together and form a wall structure.

In some embodiments, the touch fastener comprises a hook and loop fastener. In some such embodiments, the first touch fastening component comprises a loop component of the hook and loop fastener, and the second touch fastening component comprises a hook component of the hook and loop fastener.

In some embodiments, the touch fastener comprises a fire-resistant material. In some embodiments, the touch fastener comprises a water-resistant material. In some embodiments, the touch fastener further comprises a flexible sound-dampening connection when the first touch fastening component is operably engaged with the second touch fastening component.

In some embodiments, the first touch fastening component is laminated onto the back side of the wall panel sheet. In some embodiments, the wall panel sheet comprises a sheet of drywall.

In some embodiments, the second touch fastening component is separate and distinct from the framing member and attached to the outer surface of the framing member. In some embodiments, the second touch fastening component and the framing member are integral such that material of the framing member forms the second touch fastening component at the outer surface thereof. In some such embodiments, the framing member is formed of metal. In some such embodiments, the touch fastener comprises a hook and loop fastener, and wherein the second touch fastening component comprises a hook component of the hook and loop fastener. In some such embodiments, the framing member is a metal stud and the hook component is perforated into the outer surface of the metal stud.

In some embodiments, the framing member comprises a framing stud. In some such embodiments, the framing member comprises a c-channel configured to couple over a framing stud. In some such embodiments, the framing member comprises a furring strip.

In another aspect, the present disclosure provide a method for installing a wall or ceiling panel. The method comprises: obtaining at least one wall or ceiling panel sheet having a front side and a back side, the back side of the wall or ceiling panel sheet including a first touch fastening component of a touch fastener; and obtaining a framing member configured to physically support the wall or ceiling panel sheet, an outer surface of the framing member including a second touch fastening component of the touch fastener. The first touch fastening component and the second touch fastening component are configured to removably couple together when operatively engaged to removably fasten the wall or ceiling panel sheet and the framing member together and form a wall or ceiling structure.

In some embodiments, the method further comprises disposing the wall or ceiling panel sheet in relation to the framing member such that the first touch fastening component and the second touch fastening are operatively engaged to form the wall structure.

In some embodiments, the touch fastener comprises a hook and loop fastener, and wherein the first touch fastening component comprises a loop component of the hook and loop fastener, and the second touch fastening component comprises a hook component of the hook and loop fastener. In some embodiments, obtaining the framing member comprises forming the hook component from the material of the framing member such that the hook component and the framing member are integral.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

These and other objects, features and advantages of this disclosure will become apparent from the following detailed description of the various aspects of the disclosure taken in conjunction with the accompanying drawings.

BRIEF DESCRIPTION OF THE DRAWINGS

These and other features, aspects, and advantages of the present disclosure will become better understood when the following detailed description is read with reference to the accompanying drawings, which are not necessarily drawn to scale and in which like reference numerals represent like aspects throughout the drawings, wherein:

FIG. 8A is an elevational perspective exploded view of an adjustable furring strip with hook and a loop fastener attached thereto, in accordance with an aspect of the present disclosure;

DETAILED DESCRIPTION

Figure 1A:
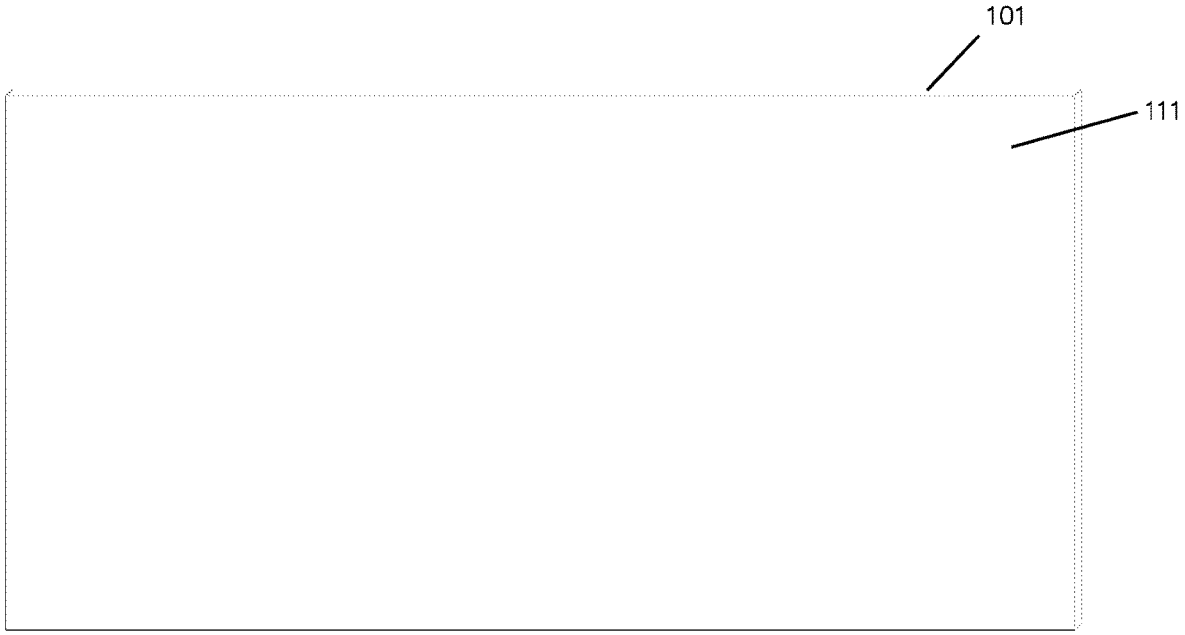
FIG. 1A is an elevational front perspective view of a sheet of a wall panel (e.g., drywall), in accordance with an aspect of the present disclosure.

The present disclosures will be discussed hereinafter in detail in terms of various exemplary embodiments according to the present disclosure with reference to the accompanying drawings. In the following detailed description, numerous specific details are set forth in order to provide a thorough understanding of the inventions. It will be obvious, however, to those skilled in the art that the present inventions may be practiced without these specific details. In other instances, well-known structures are not shown in detail in order to avoid unnecessary obscuring of the present inventions.

Aspects of the present disclosure and certain examples, features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the disclosure, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "terms "substantially", "approximately", "about", "relatively," or other such similar terms is not limited to the precise value specified, and is used to describe and account for small fluctuations, such as due to variations in processing, from a reference or parameter. Such small fluctuations include a zero fluctuation from the reference or parameter as well. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the approximating language may correspond to the precision of an instrument for measuring the value.

Terminology used herein is for the purpose of describing particular examples only and is not intended to be limiting. As used herein, the singular forms "a", "an" and "the" are intended to include the plural forms as well, unless the context clearly indicates otherwise. Furthermore, references to "one example" are not intended to be interpreted as excluding the existence of additional examples that also incorporate the recited features. Moreover, unless explicitly stated to the contrary, the terms "comprising" (and any form of "comprise," such as "comprises" and "comprising"), "have" (and any form of "have," such as "has" and "having"), "include" (and any form of "include," such as "includes" and "including"), and "contain" (and any form of "contain," such as "contains" and "containing") are used as open-ended linking verbs. As a result, any examples that "comprises," "has," "includes" or "contains" one or more step or element possesses such one or more step or element, but is not limited to possessing only such one or more step or element. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be." As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper", "lower", "left", "rear", "right", "front", "vertical", "horizontal" and derivatives thereof shall relate to the orientation as shown in FIG. 1.

The terms "connect," "connected," "contact," "coupled" and/or the like are broadly defined herein to encompass a variety of divergent arrangements and assembly techniques. These arrangements and techniques include, but are not limited to (1) the direct joining of one component and another component with no intervening components therebetween (i.e., the components are in direct physical contact); and (2) the joining of one component and another component with one or more components therebetween, provided that the one component being "connected to," "contacting" or 'coupled to" the other component is somehow in operative communication (e.g., electrically, fluidly, physically, optically, etc.) with the other component (notwithstanding the presence of one or more additional components therebetween).

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Touch fasteners are also referred to as hook and loop fasteners, hook and pile fasteners, hook and hoof fasteners and Velcro®. Touch fasteners have a first fastening component and a second fastening component that are configured to removably couple with each other, for example, a hook component and a loop component, respectively. The hook and loop components are connected to opposing surfaces/objects that are to be coupled/attached/fastened together. For example when hook and loop components are pressed together, a densely packed plurality of small hooks catches in a densely packed plurality of small loops, fastening the hook and loop components (and the surfaces/objects coupled thereto, respectively) together. Other touch fasteners include, for example, systems that have double hooks for use with loops, or systems that have interlocking, opposably facing mushroom shaped connectors (e.g. Dual Lock® by 3M®), mushrooms and loops, and hooks and hooks that engage with each other. A feature of touch fasteners is that the two objects/surfaces may be fastened and separated or unfastened (i.e., removably coupled), with the touch fastener being reusable (i.e., the two objects/surfaces being re-coupled with the same touch fasteners). While hook and loop fasteners are described as an example herein, Dual Lock® or the double hook or similar touch fasteners may be used in place of hook and loop. Further, the terms "hook" and "loop" (and the equivalents thereof) are used interchangeably herein such as a first surface/object that includes a hook component of a hook and loop fastener and a second surface/object that includes a loop component of the hook and loop fastener may alternatively be configured such that the first surface/object includes the loop component and the second surface/object that includes a hook component. Further, the terms "touch fastener" and "hook and loop fastener" (and the equivalents thereof) are used herein to refer generally to any such faster systems or mechanisms described here and known in the art.

In embodiments disclosed herein, the systems and methods for fastening (e.g., removably attaching) wall/ceiling panels (e.g., drywall panels) to one or more frame members (e.g., one or more wood or metal stud) utilize touch/hook and loop fasteners or constructs. The touch/hook and loop fasteners may comprise a hook component and a loop component. In some such embodiments, hook component may be formed from a plastic material, a woven fabric material, or a combination of plastic and woven fabric material. In some embodiments, the loop component may be formed from a plastic material, a woven fabric material, a non-woven fabric material, or velour. In some embodiments, the hook or loop portions of the touch fastener have a base that is, for example, a fabric or plastic material. In accordance with aspects of the disclosure, other materials may be used in the base. The base is generally a flexible or bendable material. The back sides of the hook or loop that are opposite the operable hook or loop include, for example, an adhesive, a solvent, or a heat sensitive material for attaching/fastening/coupling to the opposing surfaces to be connected. In some embodiments, the sides of the hook or loop that are opposite the operable hook or loop include a pressure sensitive adhesive or a heat activated adhesive for attaching/fastening/coupling to a surface/object. Other backing adhesion materials of the back side of the bases include, for example, a heat welding compound, or a solvent.

Figure 1B:
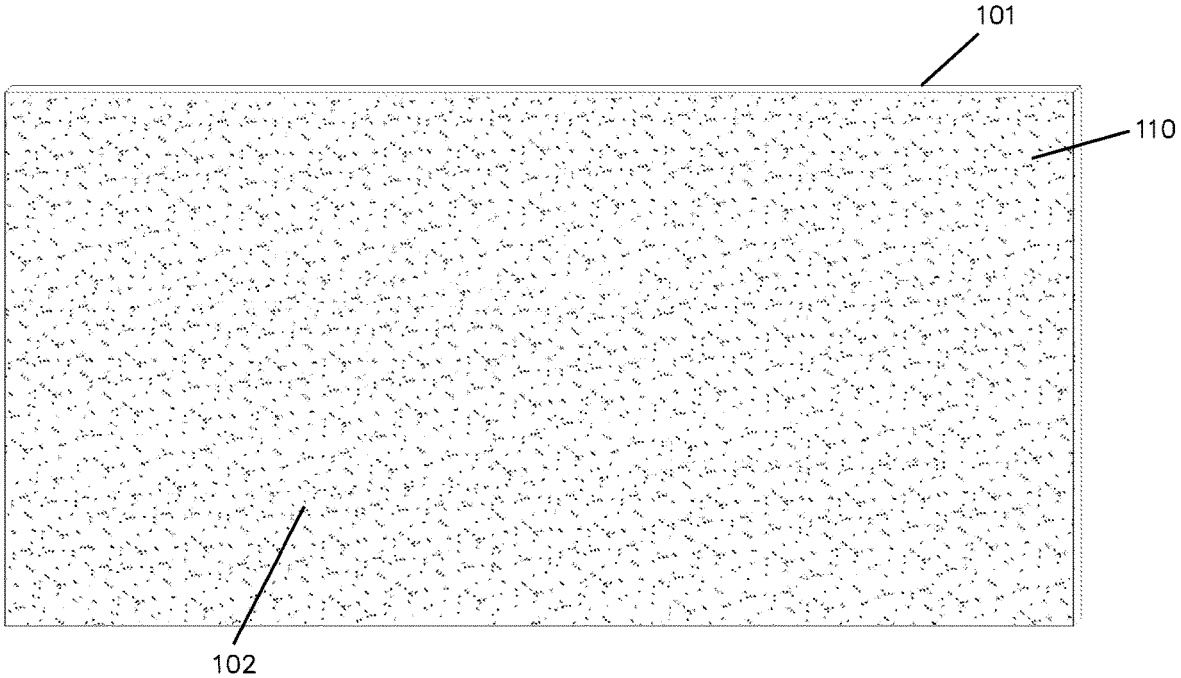
FIG. 1B is an elevational back perspective view of the sheet of the wall panel of FIG. 1A with loop/look fastener attached thereto, in accordance with an aspect of the present disclosure.
Figure 3:
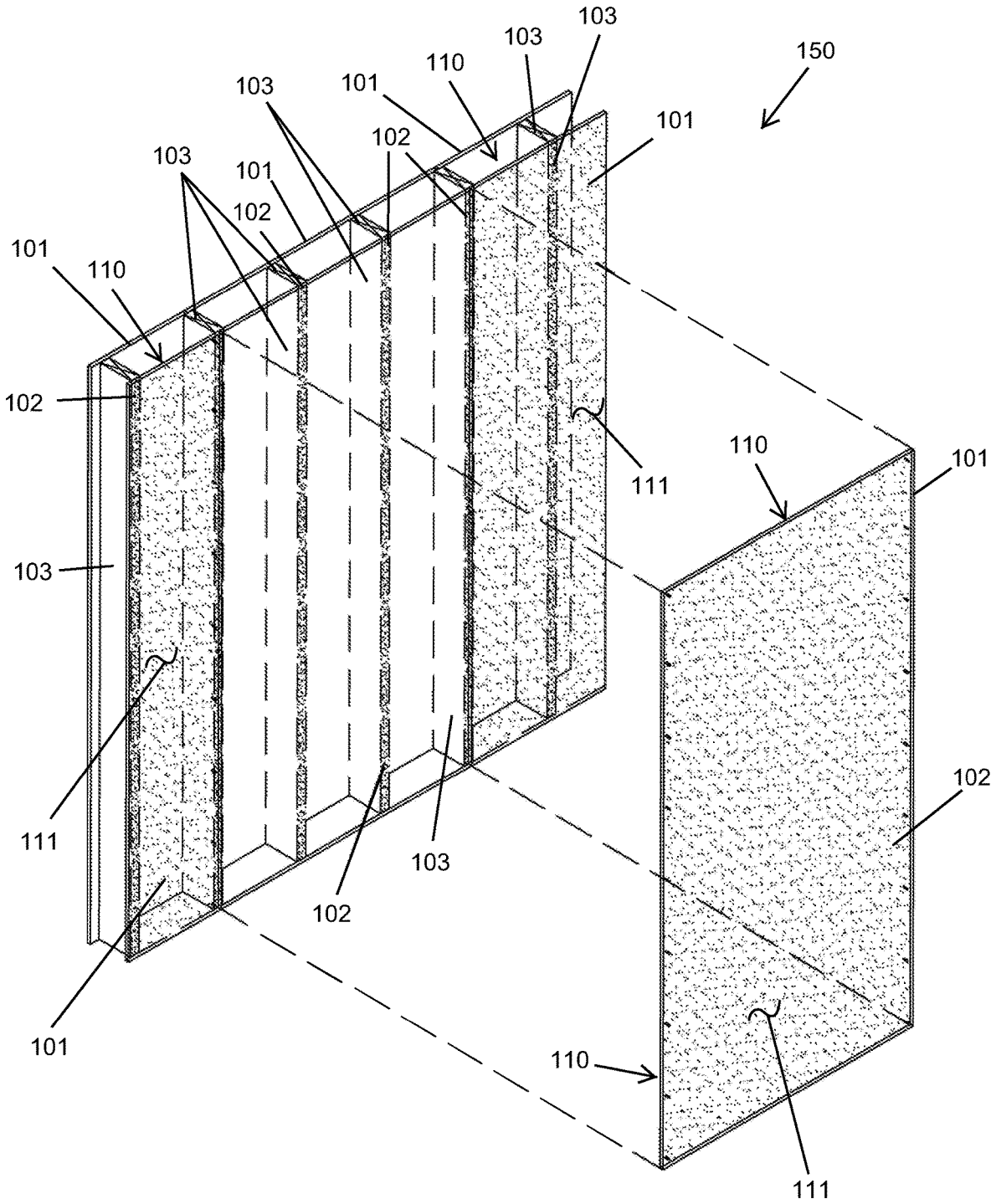
FIG. 3 is an elevational view of a wall including the sheets of the wall panel of FIGS. 1A and 1B and the framing members of FIG. 2, in accordance with an aspect of the present disclosure.

FIGS. 1A, 1B and 3 illustrate an exemplary embodiment of a wall/ceiling covering panel/sheet/material 101, such as for residential and commercial construction. As noted above, the most commonly utilized wall/ceiling covering panel/sheet 101 is drywall (also known as plasterboard, wallboard, sheet rock, gyprock, gypsum board, or gypsum panel). As such, the wall/ceiling covering panel/sheet 101 is referred to herein as drywall 101, however it is hereby contemplated that the wall/ceiling covering panel/sheet 101 may comprise any material, composition or configuration other than drywall.

As shown in FIGS. 1A, 1B and 3, a sheet of drywall 101 may have/comprise an inner surface 110 and an outer surface 111. The sheet of drywall 101 is generally affixed to a framing member such that the inner surface 110 faces the interior of the wall and the outer surface 111 faces outwards becoming the wall surface. As shown in FIGS. 1A, 1B and 3, the inner surface 110 of the sheet of drywall 101 includes a first component 102 of a touch/hook and loop fastener system/mechanism/construct thereto. In some such embodiments, the first component 102 of the touch/hook and loop fastener may comprise a loop component. As noted above, the first touch fastener component 102 may be attached (e.g., fixedly or removably) to the inner surface 110 of the sheet of drywall 101. As such, the inner surface 110 of the sheet of drywall 101 may comprise a first fastening surface.

In some embodiments, the sheet of drywall 101 comprises a panel made of calcium sulfate dihydrate (gypsum), generally with a paper-based front facing (that forms the outer surface 111) and back facing (that forms the inner surface 110). In still other aspects, other additives or materials are added to the gypsum, added as additional layers, or used in place of, or in addition to, the paper-based facing. These additives or material provide additional properties such as water-resistance, and/or fire-resistance, and/or sound-dampening, and/or mold-resistance.

The sheet of drywall 101 may comprise industrial (e.g., residential and/or commercial construction) standard heights, widths and/or thicknesses. For example, a standard widths may comprise about 48 in and about 54 in, standard heights may comprise about 8 ft, about 10 ft, about 12 ft, and about 14 ft, and standard thicknesses may comprise about ¼ in, about ⅜ in, about ½ in, and about ⅝ in. The weight of the sheet of drywall 101 may range from about 25 lbs to about 140 lbs. In some embodiments, the sheet of drywall 101 may comprise a thickness of about ½ in and a weight of about 1.7 lbs/ft$^2$, or a thickness of about ⅝ in and a weight of about 2.3 lbs/ft$^2$.

In some embodiments, a drywall sheet 101 may have dimensions of 1 ft.×4 ft.×⅝ in and/or two 2 in wide by 12 in long strips of touch fastener 102, where the first connecting portion (e.g., a loop component) 102 is attached to the inner surface 110 of the drywall sheet 101 and the second connecting portion (e.g., a hook component) 102 is attached to an outer-facing surface of a vertical support member/surface. In some such embodiments, the touch fastener 102 may be configured a peel strength of about 1 psi. In such embodiments, the drywall sheet 101 will remained mounted to the vertical support member/surface, and require intentional and significant effort to separate the first connecting component 102 from the second connecting component 102. Further, in such embodiments, removal of the drywall sheet 101 from the vertical support member/surface (i.e., separation of the first and second touch fastener components 102) does not damage the drywall sheet 101. Still further, in such embodiments, removal of the drywall sheet 101 from the vertical support member/surface (i.e., separation of the first and second touch fastener components 102) does not damage the first and second touch fastener components 102 such that they are usable to re-couple together (e.g., for at least two more touch fastener engagements).

Peel strength and sheer strength are common measures for hook and loop fasteners. In embodiments disclosed herein, drywall sheets 101 are supported with hook and loop components 102 having sheer strength ranging from, for example, about 0.3 psi to about 25 psi. As further disclosed herein, a desired peel strength to prevent inadvertent removal but easy intentional removal may be, for example, from about 0.3 lbs per inch width to about 1.2 lbs per inch width, including all ranges and subranges therein as appropriate for the mechanics of the drywall 101 installation and removal.

Figure 2:
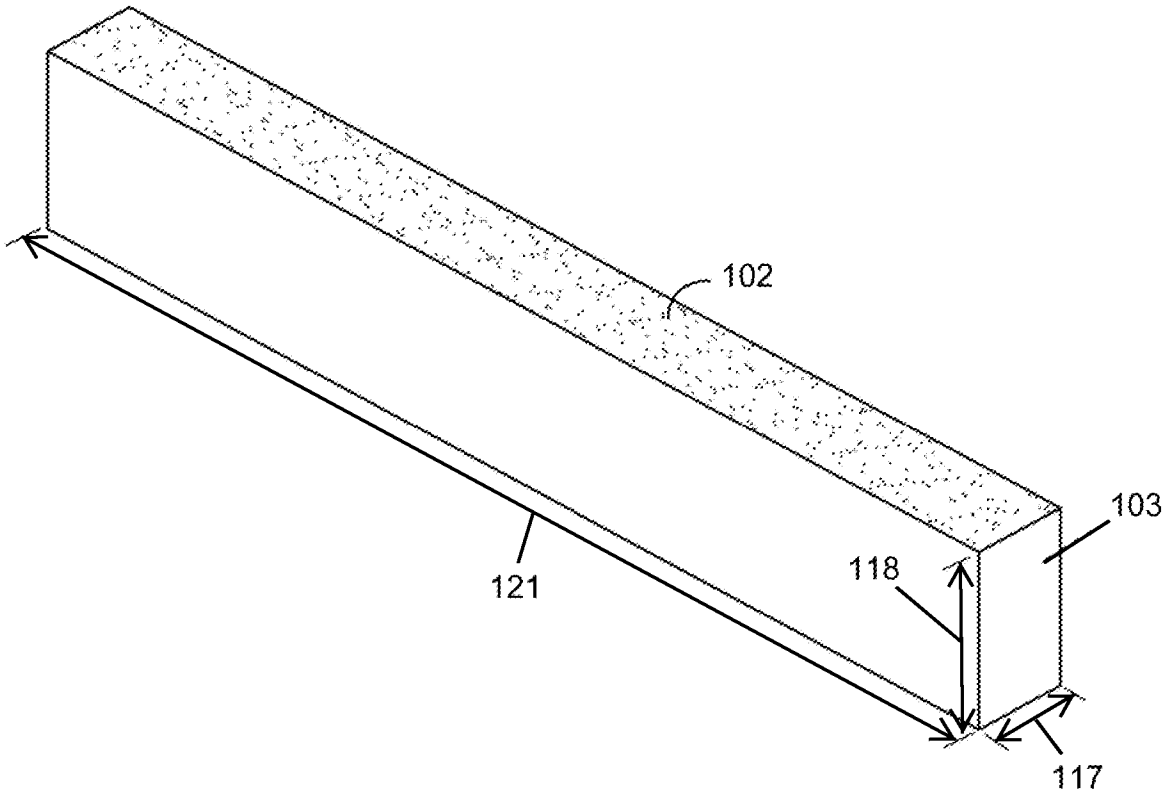
FIG. 2 is an elevational perspective view of a frame member with hook and a loop fastener attached thereto, in accordance with an aspect of the present disclosure.
Figure 4A:
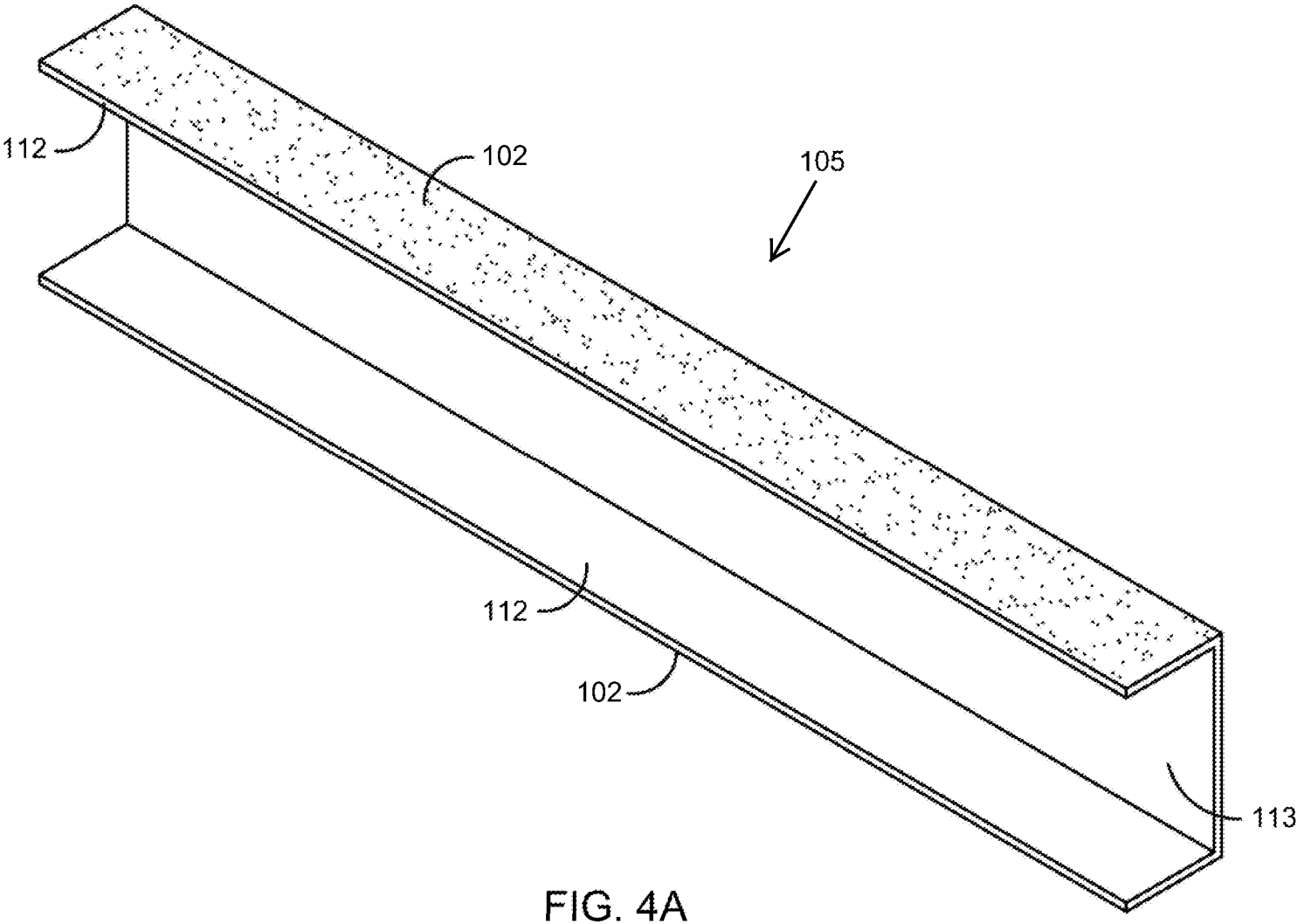
FIG. 4A is an elevational perspective view of another frame member with hook and a loop fastener attached thereto, in accordance with an aspect of the present disclosure.
Figure 4B:
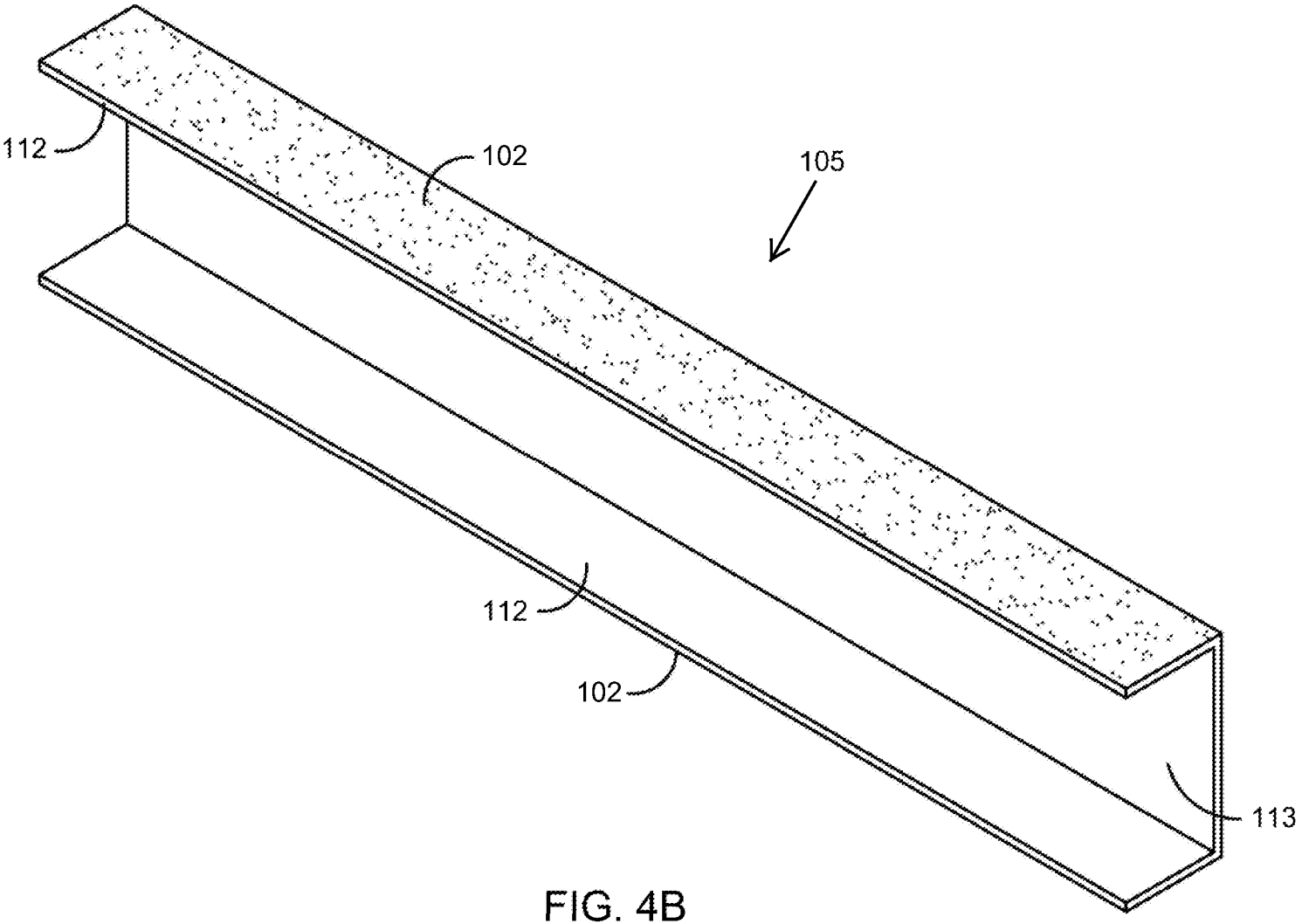
FIG. 4B is a bottom perspective view of the frame member of FIG. 4A, in accordance with an aspect of the present disclosure.
Figure 5:
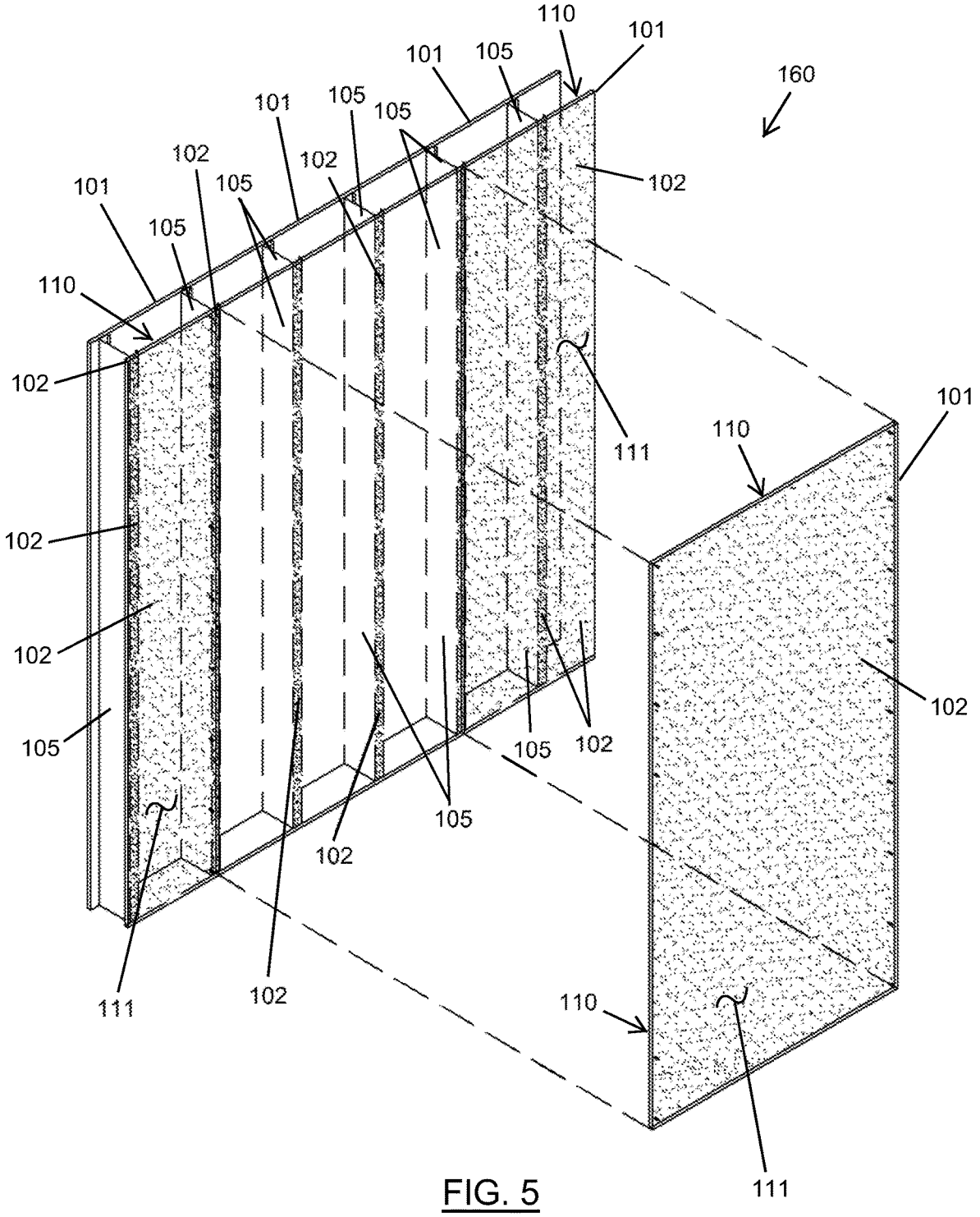
FIG. 5 is an elevational view of a wall including the sheets of the wall panel of FIGS. 1A and 1B and the framing members of FIGS. 4A and 4B, in accordance with an aspect of the present disclosure.
Figure 6:
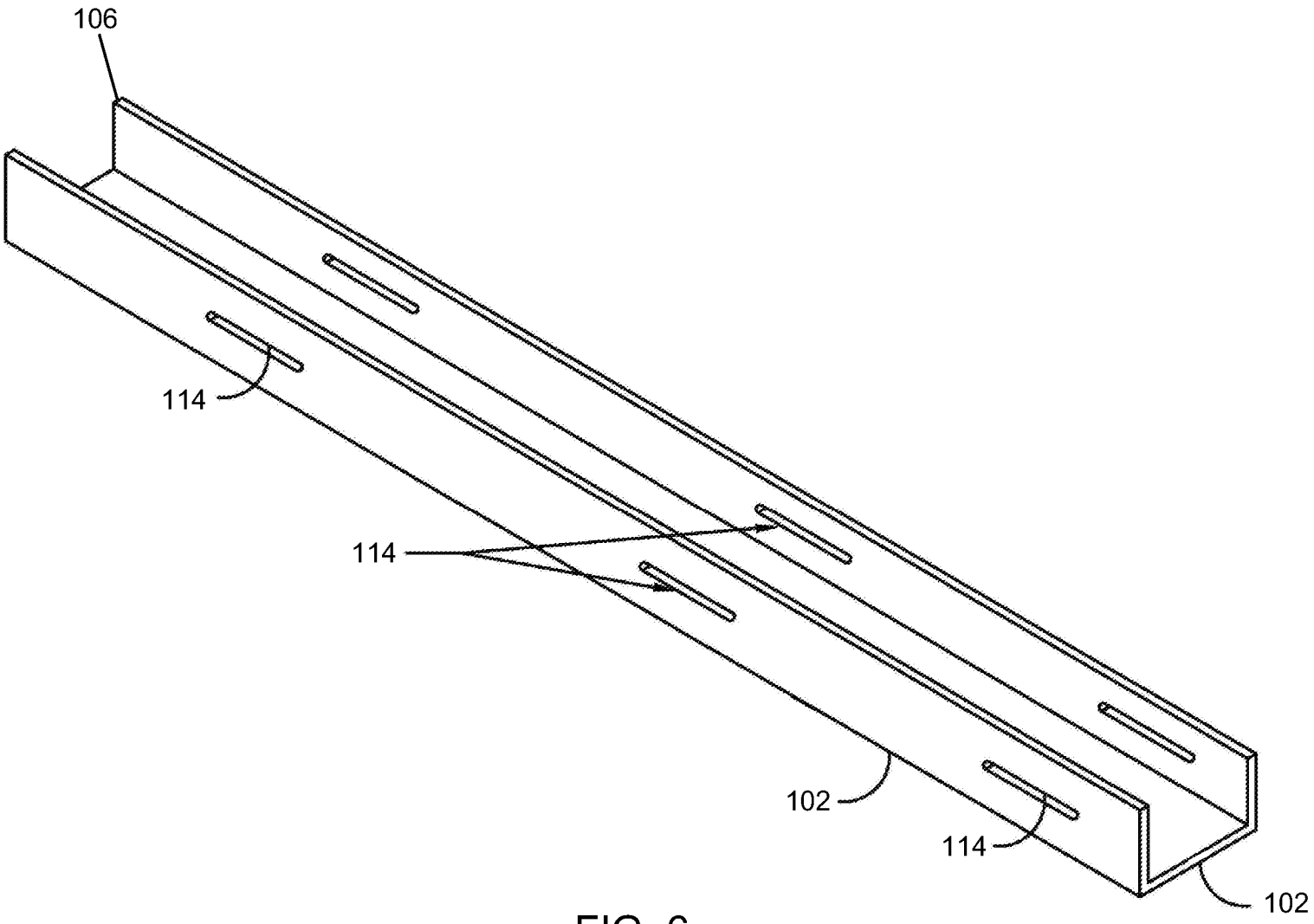
FIG. 6 is an elevational perspective view of a c-channel member with hook and a loop fastener attached thereto, in accordance with an aspect of the present disclosure.
Figure 7:
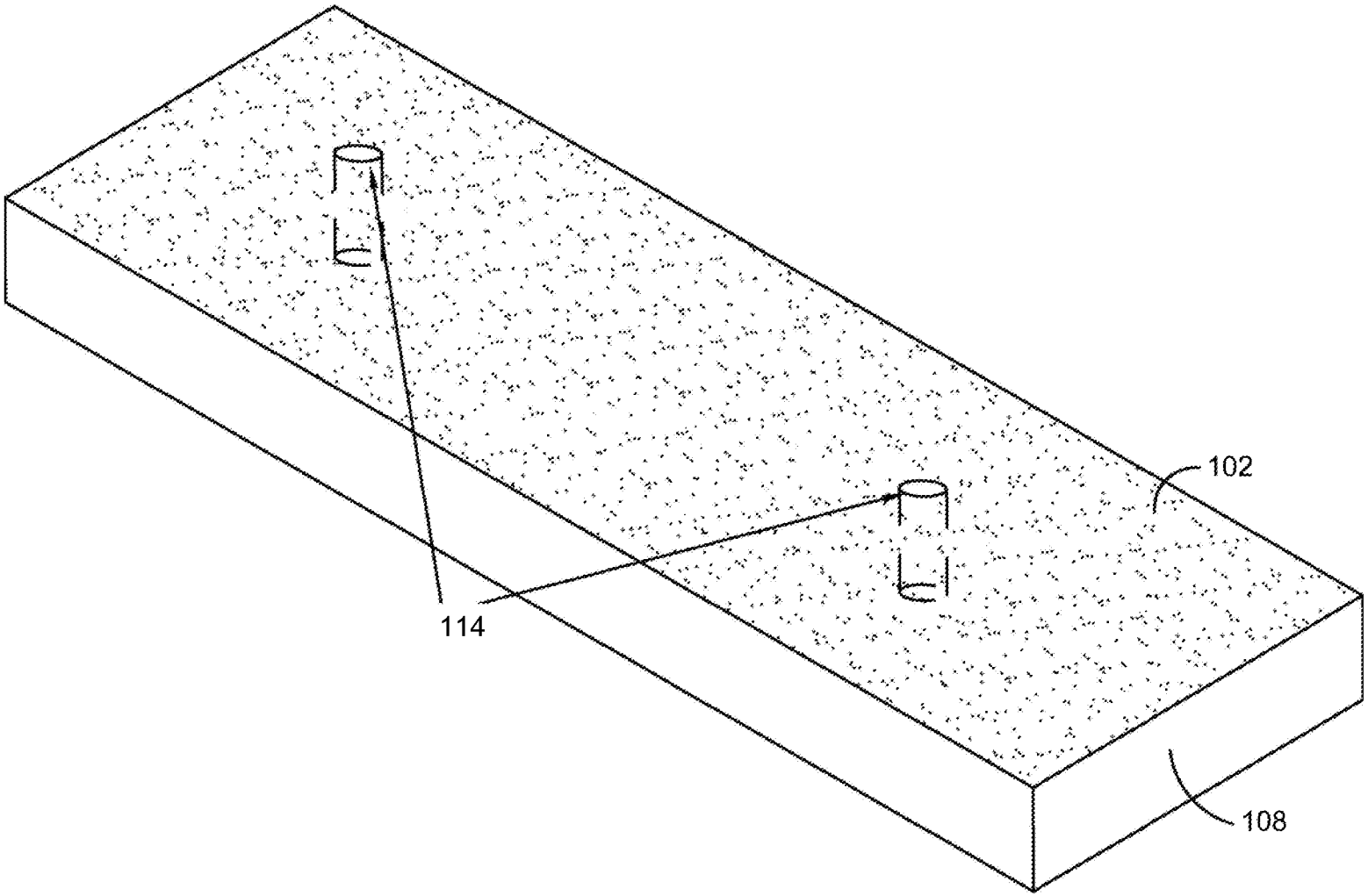
FIG. 7 is an elevational perspective view of a furring strip with hook and a loop fastener attached thereto, in accordance with an aspect of the present disclosure.
Figure 8B:
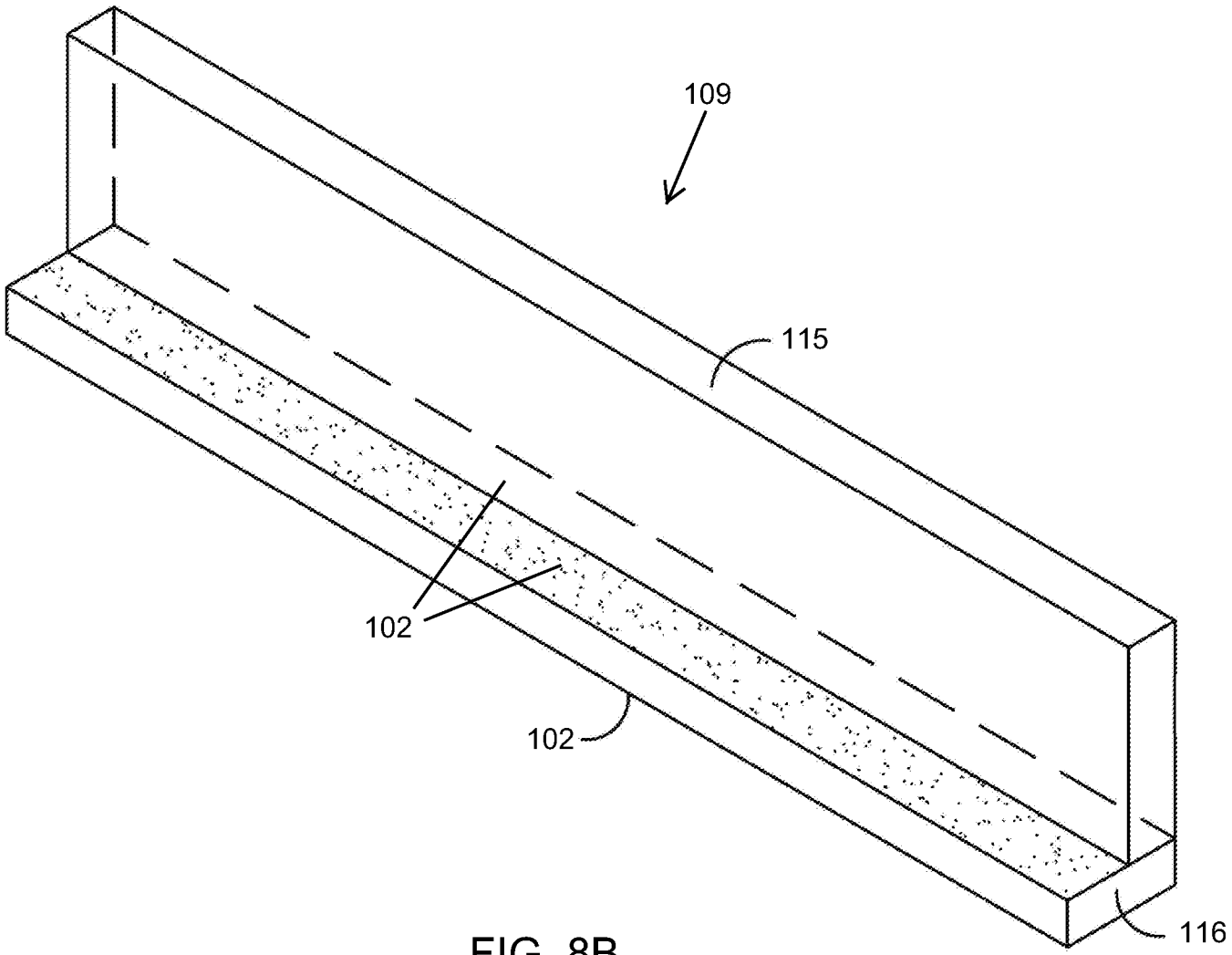
FIG. 8B is an elevational perspective view of the adjustable furring of FIG. 8A assembled, in accordance with an aspect of the present disclosure.
Figure 9:
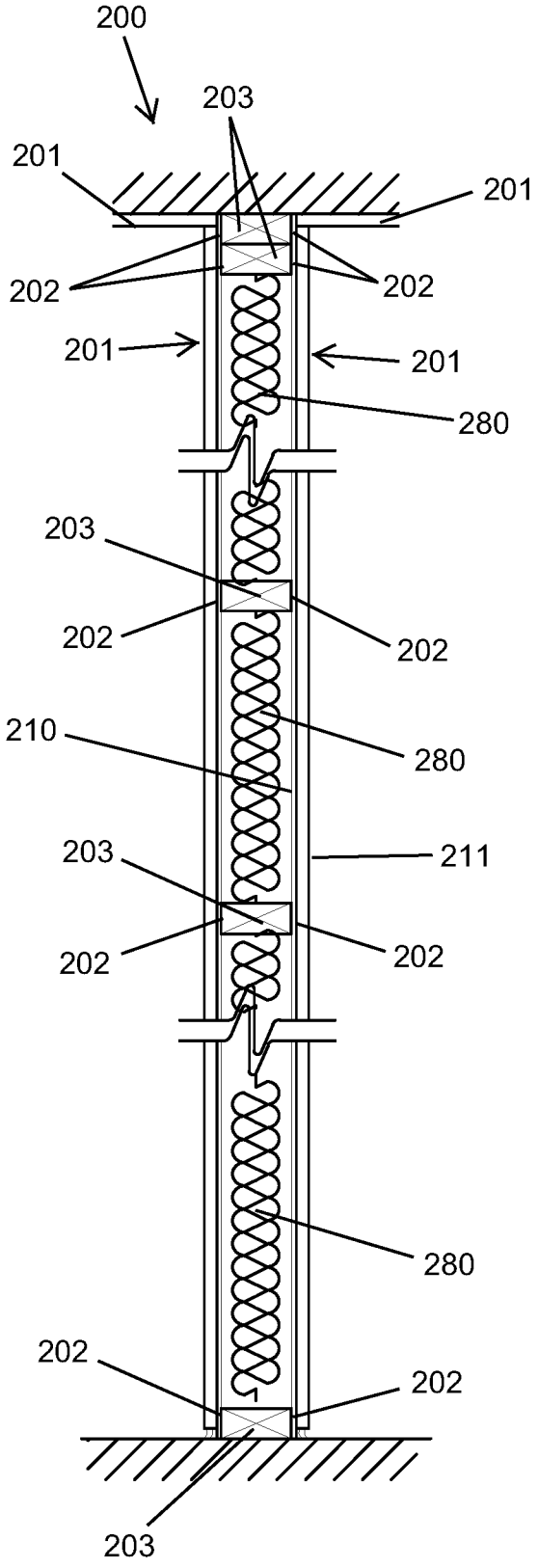
FIG. 9 is a cross-sectional view of a wall partition formed with wall panels and framing members with hook and a loop fasteners, in accordance with an aspect of the present disclosure.

FIGS. 2-10 show various support/framing members that include a touch fastener component 102 for removably coupling with the mating touch fastener component 102 on the drywall panel 101. For example, an exemplary first framing stud 103/203 (e.g., a wood stud) is shown in FIGS. 2, 3 and 9, an exemplary second framing stud 105/305 (e.g., a metal stud) is shown in FIGS. 4A-5 and 10, an exemplary c-channel 106 for a framing member is shown in FIG. 6, an exemplary framing furring strip 108 is shown in FIG. 7, and an exemplary adjustable framing furring strip 109 is shown in FIGS. 8A and 8B. As shown in FIGS. 2-10, each support/framing member includes at least a portion of one surface covered/including/comprising a touch fastener component 102 (e.g., a hook component) for removably coupling with the mating touch fastener component 102 (e.g., a loop component) on the drywall panel 101. A such, the support/framing members include a second fastening surface.

FIGS. 2 and 3 illustrate an exemplary first framing member or stud 103. In some embodiments, the first framing member 103 may comprise a wood stud. However, in other embodiments the first framing member or stud 103 may include a differing material and/or be configured differently. The first framing member 103 may comprise a standard size, such as a thickness or depth 117 and a width 118 within the range of about 2 in ×4 in to about 2 in ×12 in, including all ranges and subranges therein as appropriate for the mechanics of wall or ceiling construction/installation. It is specifically contemplated that although standard sizes of the first framing member 103 (e.g., a wood stud) are disclosed herein, the first framing member 103 (e.g., a wood stud) may equally employ/comprise non-standard or differing sizes and/or materials.

The first framing member 103 (e.g., a wood stud) may be positioned such that its length 121 is (substantially vertically) positioned between a ceiling framing member/plate/sill and a floor/base framing member/sill plate/sole plate. As shown in FIGS. 3 and 9, a series of the framing members 103/203 may be positioned/extended (e.g., substantially vertically) (e.g., between a ceiling plate and a sole plate) to form a wall/ceiling/partition 150/200 (and be positioned within an inner wall/ceiling space). For example, the width 118 may be within the wall space, perpendicular to wall surface. The thickness side 117 of the first framing member 103/203 may be the side or face to which drywall 101/201 is to be attached. Thus, the thickness side 117 may comprise the second fastening surface to which the second fastening component 102/202 of the touch fastener is connected (e.g. the hook component 102). As shown in FIG. 9, the wall space may include other framing and/or wall/ceiling components, such as but not limited to insulation 280.

FIG. 4A-5 depict a second framing member 105 (e.g., a metal stud) with, for example, a web portion 113 extending (e.g., perpendicularly) between two flange portions 112. In some embodiments, the cross-section of the second framing member 105 may comprise an I-shape (not shown), and in some other embodiments the cross-section of the second framing member 105 may comprise a C- or U-shape as illustrated in FIGS. 4A-5 (and FIG. 10). In some embodiments, the two flanges 112 may comprise a standard width of about 1⅜ in, about 1⅝ in, about 2 in, about 2½ in or about 3 in, and/or the web 113 may comprise a standard depth/width within the range of about 2½ in to 14 in, including all ranges and subranges therein. It is specifically contemplated that although standard sizes of the second framing member 105 (e.g., a metal stud) are disclosed herein, the second framing member 105 (e.g., a wood stud) may equally employ/comprise non-standard or differing sizes and/or materials.

The outer-facing surface of one or both of the flanges 112 of the second framing member 105 may be the side(s) or face(s) to which drywall 101 is to be attached. Thus, the outer-facing surface of one or both of the flanges 112 may comprise the second fastening surface that includes the second fastening component 102 (e.g. the hook component 102).

Figure 10:
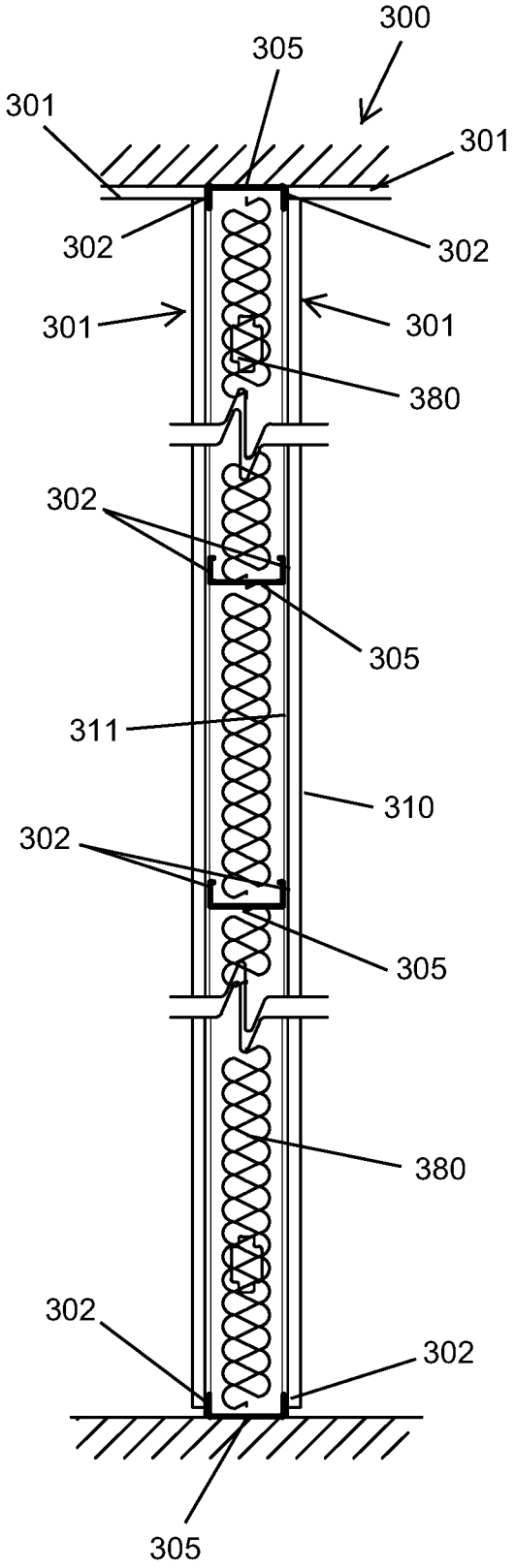
FIG. 10 is a cross-sectional view of another wall partition formed with wall panels and framing members with hook and a loop fasteners, in accordance with an aspect of the present disclosure.

As shown in FIGS. 5 and 10, the second framing member 105/305 (e.g., a metal stud) may be positioned such that its length is (substantially vertically) positioned between a ceiling framing member/plate/sill and a floor/base framing member/sill plate/sole plate. As shown in FIGS. 5 and 10, a series of the framing members 105/305 may be positioned/extended (e.g., substantially vertically) (e.g., between a ceiling plate and a sole plate to form a wall/ceiling/partition 160/300 (and be positioned within an inner wall/ceiling space). The drywall 101/301 may be attached to the outer-facing surfaces of one (or both) of the two flanges 112, as shown in FIGS. 5 and 10. Thus, the second fastening component 102/302 of the touch fastener is provided on one or both of the two flanges 112, such as, for example, the hook component 102/302, as shown in FIGS. 4A, 4B, 5 and 10. As shown in FIG. 10, the wall space may include other framing and/or wall/ceiling components, such as but not limited to insulation 380.

Generally referring to FIGS. 2-5, both the first framing member 103 (e.g., a wood stud) and the second framing member 105 (e.g., a metal stud) may be used in ceilings as joists. The term stud and joist are used interchangeably, and the joist may also be referred to as a ceiling stud. The length 121 of a stud can be any length, and may depend on the structure being built. For example, the length 121 the first framing member 103 (e.g., a wood stud) and the second framing member 105 (e.g., a metal stud) may be within the range of about 6 ft to about 16 ft, including all ranges and subranges therein. Structures may also have multiple studs substantially vertically stacked for use in taller walls. In the case of ceilings, the length 121 of the joist may be horizontally disposed, with the stud thickness/flange side 117/112, having the touch/hook and loop component 102, and positioned to connect to the mating touch/hook and loop component 102 on the back side 110 of the sheet of drywall/panel 101.

The first framing member 103/second framing member 105 may include the touch/hook and loop fastener component 102 (integral or separate and distinct and attached thereto) on one or more surfaces (e.g., one or more outer-facing surfaces) thereof. For example, regarding the second framing member 105 (e.g., a metal stud), the touch/hook and loop fastener component 102 (integral or separate and distinct and attached thereto) may be present on the outer-facing surface of one or both of the two flanges 112. In some embodiments, the first framing member 103/second framing member 105 may be manufactured/pre-configured such that the touch/hook and loop fastener component 102 thereof is provided/present on the surface(s) thereof. In some other embodiments, the first framing member 103/second framing member 105 may be void of the touch/hook and loop fastener component 102, and the first framing member 103/second framing member 105 and/or the touch/hook and loop fastener component 102 may be configured such that the touch/hook and loop fastener component 102 is formed/applied/coupled to/on the outer surface(s) (e.g., at a construction or assembly site).

In some other embodiments, the touch/hook and loop component 102 (e.g., a hook component) may comprise a separate and distinct component/piece/construct than the first framing member 103 (e.g., a wood stud) or the second framing member 105 (e.g., a metal stud) and attached thereto. For example, the touch/hook and loop component 102 may be coupled/attached to the first framing member 103 (e.g., a wood stud) or the second framing member 105 (e.g., a metal stud) via an adhesive, glue, screws, nails, staples, another attachment mechanism or a combination thereof.

In some other embodiments, the touch/hook and loop component 102 (e.g., a hook component) may be integral with the first framing member 103 (e.g., a wood stud) or the second framing member 105 (e.g., a metal stud). For example, the touch/hook and loop component 102 may be formed by the first framing member 103 or the second framing member 105. The material composition of the first framing member 103/second framing member 105 may thereby comprise a material that can form the touch/hook and loop component 102. For example, a framing member 103/105 may be formed of a metal material or a polymer/plastic material (or any other material that can be formed into the touch/hook and loop component 102 and act as a support/framing member to physically support one or more panels/drywall 101.

In one exemplary embodiment, the first framing member 103/second framing member 105 may be formed of a metal material (e.g., aluminum, steel, etc.) and include at least one integral touch/hook and loop component portion 102 (e.g., a hook component portion) on at least one outer-facing surface thereof. For example, in some such embodiments the outer surface(s) of the (e.g., metal) first framing member 103/second framing member 105 may be worked with a perforated roller die that is configured to form the material of the first framing member 103/second framing member 105 (at the worked outer surface) to form the touch/hook and loop component 102, such as the hook component/portion of a hook and loop fastener system/mechanism/construct. It is noted that other methods of forming the touch/hook and loop component portion 102 (e.g., a hook component) integrally with the first framing member 103/second framing member 105 itself may equally be employed. In some embodiments, the first framing member 103/second framing member 105 may thereby comprise a framing member (e.g., structural) with an array of a plurality of integral hooks that form a hook component/portion 102 of a touch/hook and loop fastener system/mechanism/construct that is configured to removably couple/engage/fasten with a loop component 102 of the touch/hook and loop fastener system/mechanism/construct that is attached (or otherwise associated with) one or more wall/ceiling panels 101 (e.g., drywall panels).

As shown in FIGS. 3 and 5, a plurality of the first framing members 103 and/or second framing members 105 may be spaced at intervals (e.g., regular intervals) between a ceiling plate and a sole plate, within a wall space, with the respective touch/hook and loop fastener component 102 facing in the direction on which one or more of the panels/drywall sheets 101 are to be fastened to form a wall structure 150, 160. Ideally, studs or joists would extend vertically/parallel to each other with the sides connectable to the panels/drywall sheets 101, being aligned. However, it is noted that such a uniform layout of framing members 103/105 and/or panels/drywall sheets 101 is rarely achieved and misalignment is common (e.g., potentially most commonly in construction utilizing wood studs).

Referring to FIG. 6, wall/ceiling panel fastening systems and methods of the current disclosure may include c-channel or like framing member. FIG. 6 illustrates an exemplary c-channel 106 for connection with another framing member (e.g., a stud) that does include a touch/hook and loop component 102. In some embodiments, the c-channel 106 has two arm or end lateral sections/portions connected by a medial or web section/portion, creating a C-shape or U-shape, as shown in FIG. 6. The exterior outer-facing surface of the medial or web section/portion section may include the touch/hook and loop component 102 (such as, for example, a hook component), as shown in FIG. 6. As noted above, the touch/hook and loop component 102 may be coupled to the c-channel 106 or integral with the c-channel 106. As also shown in FIG. 6, the two arm or end lateral sections/portions include apertures or slots 114 that extend therethrough.

In one embodiment, the c-channel opening portion is placed on a framing member (e.g., stud), for example the first framing member 103 or the second framing member 105, such that the interior surface/side of the two arm or end lateral sections/portions extend along the width 118 sides of the framing member. The interior surface/side of the medial or web section/portion section of the c-channel 106 may be placed in contact with (or at least in close proximity to) the thickness side 117 of the framing member. The apertures or slots 114 of the arm or end lateral sections/portions are configured to allow the shaft portion of a fastener (e.g., a screw or nail) to extend therethrough (but not the head of the fastener, for example) and into the framing member positioned between the two arm or end lateral sections/portions. In some embodiments, the web section/portion section may include the apertures or slots 114. The apertures or slots 114 may thereby be utilized with fasteners to attach the c-channel 106 to the framing member (e.g., a stud).

Referring to FIG. 7, wall/ceiling panel fastening systems and methods of the current disclosure may include a furring strip or like framing member. FIG. 7 illustrates an exemplary furring strip 108 for connection with another framing member (e.g., a stud) that does not include a touch/hook and loop component 102. As shown in FIG. 7, the furring strip 108 may include the touch/hook and loop component 102 on at least one outer exposed side/surface thereof. In some embodiments, the furring strip 108 may include at least one through aperture/hole 114, such as, for example, countersunk holes. In other embodiments, the furring strip 108 may be void of the apertures 114 (which may be formed by a user at the time of installation, for example). In operation, furring strip 108 may be fastened to an existing framing member or wall, with the touch/hook and loop component 102 facing outward. One or more panel/drywall sheet 101 with the mating touch/hook and loop component 102 (e.g., a loop component) 120 may then be attached/fastened to the touch/hook and loop component 102 (e.g., a hook component) of the furring strip 108. In certain embodiments, the furring strip 108 may be fastened to a framing member (e.g., the first or second exemplary framing member 103, 105). In others, the furring strip 108 is fastened to a wall made of, for example, cinder blocks, brick, or plaster. In embodiments where the furring strip 108 is connected to an existing wall, the furring strip 108 may be configured to extend from the existing wall surface, such that the touch/hook and loop component 102 faces away from the wall surface. In practice, for example, a plurality of furring strips (e.g., a plurality of furring strips 108) are attached to and disposed on a wall and/or framing member (e.g., studs), and a plurality of wall/ceiling panels/drywall sheets 101 are connected to the furring strips through a plurality of touch fasteners 102, creating a new wall face in front of the old wall.

FIGS. 8A and 6B illustrate another exemplary furring strip 109 for connection with another framing member (e.g., a stud) that does not include a touch/hook and loop component 102. Furring strip 109 differs from exemplary furring strip 108 in that furring strip 109 is an adjustable furring strip that forms an L-shape. As shown in FIG. 8A, the furring strip 109 may comprise a front member/portion 116 and a side member/portion 115. The front member/portion 116 and a side member/portion 115 may be separate and distinct pieces or components that are coupled together, as shown in FIG. 8A. In some alternative embodiments, the front member/portion 116 and a side member/portion 115 may comprise an single integral piece or component.

In some exemplary embodiments, the front member/portion 116 may be configured (e.g., shaped and dimensioned) to be, for example, in the range of about 2 in wide by about ¾ in thick, including all ranges and subranges therein, limited only by practical considerations in the mechanical construction of front member/portion 116 and in the mechanics of the panel/drywall 101 installation. In some exemplary embodiments, the side member/portion 115 may be configured (e.g. shaped and dimensioned) to be, for example, in the range of about 4 in wide by about ¾ in thick, including all ranges and subranges therein, limited only by practical considerations in the mechanical construction of side member/portion 115 and in the mechanics of the panel/drywall 101 installation. The width, thickness, and length of the front member/portion 116 and/or the side member/portion 115 may vary with the applications and with the width 118 and thickness 117 of the framing member (e.g., the first or second framing member 103, 104) to which the adjustable furring strip 109 is attached.

As shown in FIGS. 8A and 8B, the front member 116 may include the touch/hook and loop component 102 at/on the front face and/or back outer face thereof (for example, a hook component 102). The side member 115 may be placed in contact with the framing member (e.g., the first or second framing member 103, 104) such that the width 118 face of the framing member is in contact with a width face of the side member 115. The side member 115 may have the touch/hook and loop component 102 (for example, a loop component 102) attached to the thickness side 117 for contact with the mating the touch/hook and loop component 102 of the front member 116. The side member 115 can be positioned such that the touch/hook and loop component 102 is facing out from the wall space. The adjustable furring strip 109 can be used when the framing member spacing and positioning needs to be adjusted for the creation of aligned members such that placement of a plurality of panel/drywall sheets 101 against the aligned members result in a flat (or flatter) wall/ceiling surface.

As noted above, some touch/hook and loop fasters/systems/constructs may utilize a hook component 102. It is noted that different types of hook components 102 may be utilizes. For example, single hook or "J-hook" type hook components 102 may be utilized, such as for wall/vertical orientated panel/drywall 102 applications. As another example, double hook or "T-hook" type hook components 102 may be utilized, such as for ceiling/horizontal orientated panel/drywall 102 applications.

In some embodiments, the touch/hook and loop component 102 (for example, a loop component) of a touch/hook and loop fastener system/mechanism/construct is attached/coupled/connected (e.g., directly or indirectly) to the back side 110 of a wall/ceiling panel/drywall sheet 101 through, for example, lamination, heating, or use of a chemical solvent or an adhesive. In some embodiments, the touch/hook and loop component 102 may be affixed/connected to or formed from/of another member/object, for example, the first framing member 103 (e.g., a wood stud), the second framing member 105 (e.g., a metal stud), the c-channel 106, the furring strip 108, or the adjustable furring strip 109. There may be other framing members, or accessories, to which a touch/hook and loop component 102 is connected or formed from/of.

As noted above, the use of a "hook" component verse a "loop" component with respect to any component is only for explanatory purposes, and the use of the "hook" component verse a "loop" component may equally be employed in a reversed orientation/arrangement.

In some embodiments, a touch/hook and loop component 102 may have additives or layers to provided beneficial, commercially viable and needed feature properties such as, for example, moisture/water-resistance, and/or fire resistance, and/or sound dampening. Typically, it is customary and well known in the art to provide fire resistance by increasing the amount of gypsum within drywall 101. Water resistance may be increased in panels/drywall 101 by adding one or more water resistant layers there-within (and/or adding paper treatment to the inner surface 110 thereof, for example). Sound dampening may be achieved by using multiple sheets of panels/drywall 101 to prevent or minimize vibration transmission through the panels/drywall 101 and through the fasteners attaching the panels/drywall 101 the framing members. Providing fire-resistance, and/or water resistance, and/or sound dampening features through the touch/hook and loop components 102 rather than the panels/drywall 101 minimizes the need for using a plurality of layer of panels/drywall 101 and/or such specially treated/configured panels/drywall 101. The touch/hook and loop fastener system/mechanism/construct itself mitigates the need to use an additional feature component within the panels/drywall 101 to achieve such moisture/water-resistance, fire resistance, and/or sound dampening.

For example, an unexpected result of the wall/ceiling panel fastening systems and methods of the current disclosure is achieved via the installation method disclosed herein using touch fasteners. Namely, when the touch/hook and loop components 102 (comprising a flexible/bendable/pliable material (plastic, fabric, plasticized fabric, metal, etc.) are installed/formed on the panels/drywall 101 and the framing members supporting the panels/drywall 101 (e.g., the first framing member 103 (e.g., a wood stud), the second framing member 105 (e.g., a metal stud), the c-channel 106, the furring strip 108, or the adjustable furring strip 109) in accordance with the disclosed systems and methods, the construct exhibits and is characterized by a highly-desired and commercially needed expansion and contraction accommodation and sound-dampening effect. This sound dampening characteristic can be measured from the touch/hook and loop fastener system/mechanism/construct itself, standing alone, however, in still other embodiments, additional sound-dampening materials or substances may be added, for example, to at least one of the touch/hook and loop components 102, to further dampen sound transmission through the panel/drywall sheet 101.

Similarly, a fire-resistance or the moisture/water-resistance barrier may also be added to the touch/hook and loop fastener system/mechanism/construct, for example, the hook component 102 and/or the loop component 102. In addition, the touch/hook and loop fastener system/mechanism/construct may be able to amplify feature properties within a panel/drywall sheet 101 by providing, for example, a greater water-resistance, fire-resistance and/or sound dampening.

The use of rigid fasteners, such as nails or screws, to attach a panel/drywall sheet 101 to framing members provide for sound vibration transmission through the panel/drywall sheet 101 and through the framing members (i.e., the walls/ceilings) to which the panel/drywall sheet 101 is affixed. However, the use of flexible touch/hook and loop components 102 provides for sound dampening and contraction/expansion of the wall/ceiling construct, for example.

Further, tapes and adhesives may be utilized to attach a panel/drywall sheet 101 to framing members, but neither can effectively be used as a secure fastening mode without the use of rigid fasteners (e.g., screws or nails). For example, tapes provide for poor connections on uneven surfaces and may require some cure time to effectively adhere to the surfaces to be connected. Use of glue, a solvent, or an epoxy without the use of screws or nails is also not effective because glue or epoxy requires extended cure time, making support means to maintain drywall position essential during curing. Furthermore, curing requires supporting the panel/drywall sheet 101 sheets in a fixed position for a period of several hours to several days.

Multiple feature properties may be added to the touch/hook and loop fastener system/mechanism/construct of the present disclosure. For example, a first touch/hook and loop components 102 may include one feature property and the mating second touch/hook and loop components 102 may include a second feature property. A touch/hook and loop fastener system/mechanism/construct may include, for example, a hook component 102 with a fire-resistance barrier and a loop component 102 with a water-resistance barrier.

One exemplary method for installing a wall-ceiling panel/drywall sheet 101 with a fastening system of the present disclosure may be performed as follows. A plurality of wall-ceiling panels/drywall sheets 101 comprising the first fastening component 102 of the touch fastener configured to be operable with the second fastening component 102 of the touch fastener on a framing member (e.g., a joist and/or stud) is provided. The framing members are installed as required by building specification or standard construction requirements, such that the second touch fastening component 102 faces the panels/drywalls sheets 101 that are to be affixed. Using a level adjusted at a desired height, a panel/drywall sheet 101 is placed such that the first fastening component 102 is before the second fastening component 102 and a width of the panel/drywall sheet 101 is aligned with the level. The panel/drywall sheet 101 is then pressed against the framing member such that the first fastening component 102 and the second fastening component 102 are engaged, fastening the panel/drywall sheet 101 to the framing member(s). A plurality of panel/drywall sheets 101 may be, for example, adjacently placed and connected in such a manner to framing members form a wall or ceiling surface.

In some embodiments, the method may include attaching the first fastening component 102 of the touch fastener to the panels/drywall sheets 101, such as adhering, gluing, pressing, rolling or otherwise securely affixing the first fastening component 102 to the back side 110 of the panels/drywall sheets 101. In some embodiments, the method may include attaching the second fastening component 102 of the touch fastener to the framing members, such as adhering, gluing, pressing, rolling or otherwise securely affixing the second fastening component 102 to one or more exposed surfaces of the framing members. In some other embodiments, the method may include forming the second fastening component 102 of the touch fastener from the framing member (i.e., an integral fastening component, such an array of hook members as a hook component). For example, in some such embodiments the method may include obtaining a framing member (such as, but not limited to, a metal or polymer stud, c-channel, furring strip or the other support framing member) and forming an array of a plurality of hook members as a hook component of a touch/hook and loop fastener system/mechanism/construct that is configured to removably couple with a loop, hook or other component of the touch/hook and loop fastener system/mechanism/construct. In some such embodiments, the formation of the array of a plurality of hook members may comprise working the framing member with a perforated roller die. As noted above, in some embodiments the framing members may comprise the first framing member 103 (e.g., a wood stud), the second framing member 105 (e.g., a metal stud), the c-channel 106, the furring strip 108, or the adjustable furring strip 109.

The wall/ceiling panel fastening systems and methods of the current disclosure provide for wall/ceiling constructs void of screws or nails (or the like) for connecting the panels/drywall 101 to the framing members. By minimizing or eliminating the need for using screws or nails (or the like) to attach the panels/drywall 101 to the framing members, the installation is faster, because touch fasteners may be mounted and installed by aligning the panel/drywall sheet 101 and pressing the panel/drywall sheet 101 towards the framing member(s) to engage the touch fastener 102. The need to screw in screws or hammer in nails to support the panel/drywall 101 is minimized or eliminated, thus reducing installation time.

In an environment where existing studs or other framing members are present but there is no second touch/hook and loop fastening component 102 thereon, the c-channel 106, or the furring strip 108, or the adjustable furring strip 109, may be connected to the studs or other framing members to create a surface with the second fastening component 102 facing out from the wall. The panels/drywall sheets 101 may then be aligned so that the first fastening component 102 attached thereto and the second fastening component 102 studs or other framing members are engaged. The plurality of panels/drywall sheets 101 can be, for example, adjacently placed and connected in such a manner form a wall/ceiling surface via the studs or other framing members.

In an environment where there is an existing plaster, or brick, or cinder-block wall, for example, the furring strip 108 may be attached (e.g., screwed) to the wall, such that the side with the second fastening component 102 thereof faces out from the wall. The inner side 110 of the panels/drywall sheets 101 with the first fastening component 102 (e.g., a loop component) may be aligned with and engaged with the second fastening component 102 (e.g., a hook component) of the furring strips 108. A plurality of panels/drywall sheets 101 may be placed adjacent to one another to form a wall surface via the furring strips 108.

It is noted that the panels/drywall sheets 101 may be installed horizontally or vertically. For example, a level thereof can be adjusted to account for the width or height of the panel/drywall sheet 101 and the wall height/width.

In some embodiments, the panels/drywall sheets 101 may include a first fastening component 102 of a touch/hook and loop fastener system/mechanism/construct on the back side 110 of the panel/drywall sheet 101 and a second fastening component 102 of the on the touch/hook and loop fastener system/mechanism/construct on the front side 111 of the panel/drywall sheet 101. By connecting a plurality of such panels/drywall sheets 101 front side 111 to back side 110 thereof (and with the plurality of panels/drywall sheets 101 being substantially parallel to each other) the first fastening component 102 and the second fastening component 102 become operatively engaged to removably securely couple the panels/drywall sheets 101—creating a stack of panels/drywall sheets 101. The stack of the plurality of panels/drywall sheets 101 may exhibit multiple properties, or a single property may be amplified. For example, such a stack of a plurality of panels/drywall sheets 101 may provide a high level of soundproofing (such as for a movie theater or any other application where sound damping/proofing is desirable).

It is further noted that the wall/ceiling panel fastening systems and methods of the current disclosure provide for the removal of the panels/drywall sheets 101 from the framing members without damaging the framing members. For example, panels/drywall sheets 101 may be, for example, pulled away from the framing members such that the touch fastening components 102 of the touch/hook and loop fastener system/mechanism/construct are separated or disengaged from each other. Thereafter, new panel/drywall sheet 101 with new a touch fastening component 102 may then be operatively coupled to the touch fastening component 102 of the framing member(s) to replace the old panel/drywall sheet 101 and reform the wall/ceiling structure.

While the terms "wall member" and "wall" are used, drywall may also be used as a ceiling and/or floor material. The use of the terms wall member and wall shall also be understood to include ceiling member and ceiling, and floor member and floor, or any other building member within a wall space, ceiling space, or floor space. The embodiments shown in FIGS. 1-10 may also be used in ceiling and/or floor construction. These embodiments are described in regard to wall use, however one skilled in the art would understand that these apparatuses, devices, systems, and methods may be used with ceilings and floors.

While standard measurements are provided for accessories, framing members and wall/ceiling covering panels (e.g., drywall), such may equally be employed/configured with non-standard or differing measurements.

It is to be understood that the above description is intended to be illustrative, and not restrictive. For example, the above-described examples (and/or aspects thereof) may be used in combination with each other. In addition, many modifications may be made to adapt a particular situation or material to the teachings of the various examples without departing from their scope. While dimensions and types of materials may be described herein, they are intended to define parameters of some of the various examples, and they are by no means limiting to all examples and are merely exemplary. Many other examples will be apparent to those of skill in the art upon reviewing the above description. The scope of the various examples should, therefore, be determined with reference to the claims included herein, along with the full scope of equivalents to which such claims are entitled.

As used herein, the terms "including" and "in which" are used as the plain-English equivalents of the respective terms "comprising" and "wherein." Moreover, as used herein, the terms "first," "second," and "third," etc. are used merely as referee labels, and are not intended to impose numerical, structural or other requirements on their objects. Forms of term "based on" herein encompass relationships where an element is partially based on as well as relationships where an element is entirely based on. Forms of the term "defined" encompass relationships where an element is partially defined as well as relationships where an element is entirely defined. Further, the limitations of the claims included herein are not written in means-plus-function format and are not intended to be interpreted based on 35 U.S.C. § 112, sixth paragraph, unless and until such claim limitations expressly use the phrase "means for" followed by a statement of function cavity of further structure. It is to be understood that not necessarily all such objects or advantages described above may be achieved in accordance with any particular example. Thus, for example, those skilled in the art will recognize that the devices, systems and methods described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of examples, it should be readily understood that the disclosure is not limited to such disclosed examples. Rather, this disclosure can be modified to incorporate any number of variations, alterations, substitutions or equivalent arrangements not heretofore described, but which are commensurate with the spirit and scope of the disclosure. Additionally, while various examples have been described, it is to be understood that aspects of the disclosure may include only one example or some of the described examples. Also, while some disclosure are described as having a certain number of elements, it will be understood that the examples can be practiced with less than or greater than the certain number of elements.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

What is claimed is:

1. A wall panel fastening system comprising:

a wall panel sheet having a front side and a back side;

a framing member configured to physically support the wall panel sheet; and a touch fastener comprising a first touch fastening component and a second touch fastening component configured to removably couple together when operatively engaged, the back side of the wall panel sheet including the first touch fastening component and an outer surface of the framing member including the second touch fastening component, wherein the framing member is a metal stud, and wherein the wall panel sheet is disposed in relation to the framing member such that the first touch fastening component is operably engaged with the second touch fastening component to removably fasten the wall panel sheet and the metal stud together and form a wall structure, wherein the touch fastener comprises a hook and loop fastener, and the second touch fastening component comprises a hook component of the hook and loop fastener, and wherein the hook component and the metal stud are integral, and the hook component is perforated into the outer surface of the metal stud.

2. The system of claim 1, wherein the first touch fastening component comprises a loop component of the hook and loop fastener.

3. The system of claim 1, wherein the touch fastener comprises a fire-resistant material.

4. The system of claim 1, wherein the touch fastener comprises a water-resistant material.

5. The system of claim 1, wherein the touch fastener further comprises a flexible sound-dampening connection when the first touch fastening component is operably engaged with the second touch fastening component.

6. The system of claim 1, wherein the first touch fastening component is laminated onto the back side of the wall panel sheet.

7. The system of claim 1, wherein the wall panel sheet comprises a sheet of drywall.

8. The system of claim 1, wherein the framing member is formed of metal.

9. The system of claim 1, wherein the metal stud comprises a framing stud.

10. The system of claim 1, wherein the framing member comprises a c-channel.

11. A method for installing a wall or ceiling panel comprising:

obtaining at least one wall or ceiling panel sheet having a front side and a back side, the back side of the wall or ceiling panel sheet including a loop component of a hook and loop fastener; and operatively engaging the loop component and a hook component of the hook and loop fastener of a metal stud configured to physically support the wall or ceiling panel sheet, wherein the loop component is perforated into an outer surface of the metal stud.

12. The method of claim 11, wherein operatively engaging the loop component and the hook component of the hook and loop fastener comprises disposing the wall or ceiling panel sheet in relation to the metal stud such that the loop component and the hook component are operatively engaged.

* * * * *